United States Patent [19]

Keller et al.

[11] Patent Number: 4,867,674

[45] Date of Patent: Sep. 19, 1989

[54] METHOD AND DEVICE FOR PROCESS HEAT GENERATION

[75] Inventors: Jakob Keller, Dottikon; Thomas Sattelmayer, Mandach, both of Switzerland

[73] Assignee: BBC Brown Boveri AG, Baden, Switzerland

[21] Appl. No.: 163,712

[22] Filed: Mar. 3, 1988

[30] Foreign Application Priority Data

Mar. 11, 1987 [DE] Fed. Rep. of Germany ..... 3707773

[51] Int. Cl.[4] ..... F23D 15/00

[52] U.S. Cl. ..... 431/351; 431/10; 122/44 R

[58] Field of Search ..... 431/10, 351, 2, 354, 431/355; 110/263, 347; 122/1 C, 44 R

[56] References Cited

U.S. PATENT DOCUMENTS

| | | | |
|---|---|---|---|
| 3,955,909 | 5/1976 | Craig et al. | 431/10 |
| 4,343,606 | 8/1982 | Blair et al. | 431/10 |
| 4,388,062 | 6/1983 | Bartok et al. | 431/10 |

FOREIGN PATENT DOCUMENTS 3501934 8/1985 Fed. Rep. of Germany .

*Primary Examiner*—Noah P. Kamen

*Attorney, Agent, or Firm*—Burns, Doane, Swecker & Mathis

[57] ABSTRACT

In the method, a process medium (14) is heated in two stages, in which fuel oil and gas premixed with air in a burner device (1) are partially burnt in a preliminary combustion chamber (12) substoichiometrically with an air coefficient (λ) of approximately 0.7. The partially burnt mixture, which is low in nitrogen oxides, reaches a temperature of 1800°-1900° C., heats the process medium (14), which is already preheated to an intermediate temperature, to its final temperature in a heat exchanger (13) with counter-current flow and is cooled to 700°-900° C. In an air injection region (15) of the process heat generator the partially burnt mixture is mixed with quenching air in a stoichiometric ratio with respect to the unburnt fractions and is thereby completely burnt in a secondary combustion chamber (18) during which practically no nitrogen oxides ($NO_x$) are produced. It reaches a temperature of 900°-1300° C. and then heats the process medium (14) from its initial temperature to the aforesaid intermediate temperature in a second heat exchanger (19). The process medium flows between the two heat exchangers (13, 19) and the process medium discharge line (25) in an annular duct (22) which essentially forms the outer boundary of the process heat generator.

6 Claims, 1 Drawing Sheet

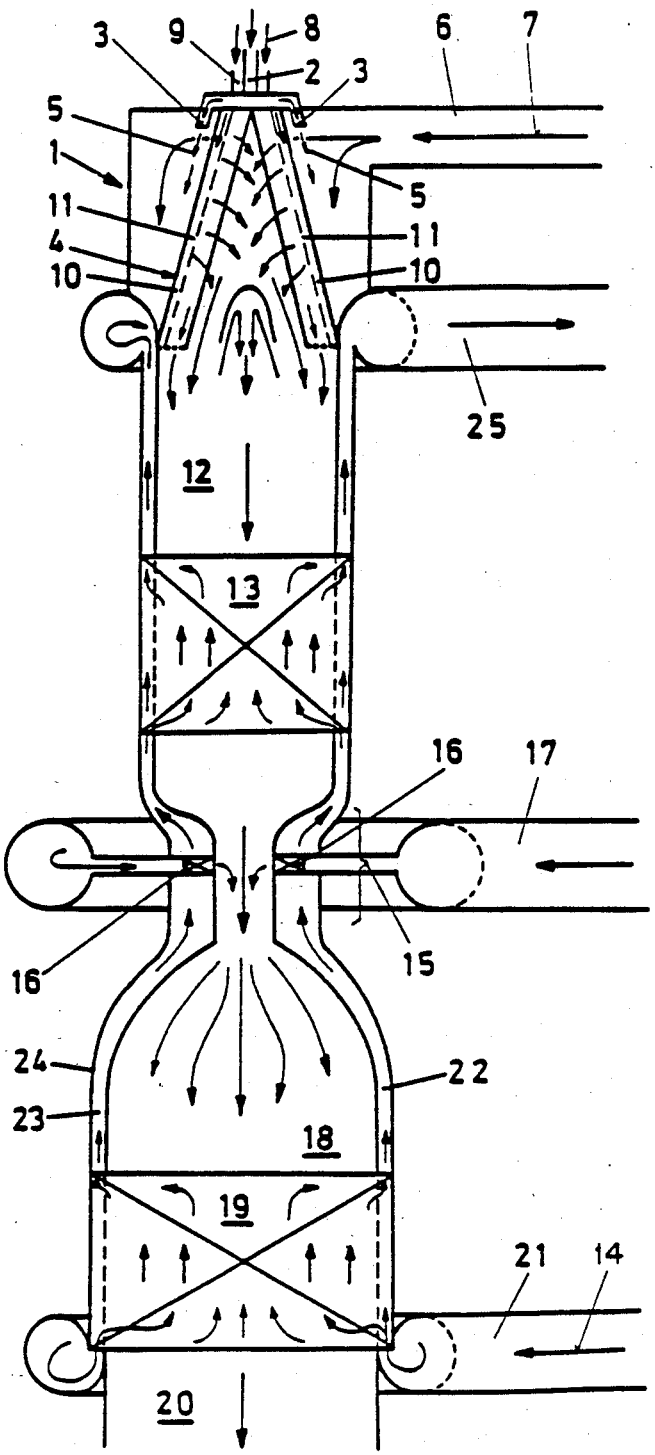
3
9
8
2
3
6
7
5
1
5
11
11
4
10
10
25
12
13
16
17
16
15
24
22
23
18
19
21
14
20

METHOD AND DEVICE FOR PROCESS HEAT GENERATION

BACKGROUND OF THE INVENTION

1. Field of the Invention

The present invention relates to a method and a device for process heat generation, and more particularly to a method wherein a process medium is heated to its final temperature in two stages by combustion products of one or more fossil fuels, preferably fuel oil and/or fuel gas.

2. Discussion of Background

Increasingly strict requirements are being imposed on process heat generators with respect to the maximum permissible emission of harmful substances. In this context the nitrogen oxides and sulphur dioxide present in the gases exhausted from the heating devices of heat generators are considered to be especially environmentally harmful. To minimize the formation of nitrogen oxides, the percent of nitrogen in the substances which take part in the combustion process should be maintained as low as possible without causing any detriment to the utilization of the fuel. Furthermore, the phase of the combustion having the best conditions for $NO_x$ formation should be kept as short as possible.

The first requirement can be fulfilled at stoichiometric conditions at which, however, high temperatures appear. These high temperatures favor the formation of nitrogen oxides. In such a case it is also difficult to obtain complete combustion. Because complete combustion requires a sufficient time, and thus a correspondingly long residence time for the fuels in the heating device of the components taking part in the combustion, the two conditions mentioned above cannot easily be reconciled.

SUMMARY OF THE INVENTION

Accordingly, one object of this invention is to provide a novel method and device for process heat generation having low $NO_x$ formation in which a new type of approach is followed, wherein, in a first preliminary combustion phase, air is mixed with the fuel in a substoichiometric ratio, and in a second phase the resulting, still combustible, gas is mixed, after initial cooling in a heat exchanger and further cooling by quenching air, with a stoichiometric quantity of air required for complete combustion of the still combustible components. A further release of heat from the combustion to the process medium takes place in a second heat exchanger. In this way, the conditions that favor $NO_x$ formation are minimized during the course of the combustion.

In the method for process heat generation according to the present invention, the fuels are burned in two stages. The process medium is preheated by the combustion gases of the second stage to an intermediate temperature, and is then heated to its required final temperature by the combustion gases that are formed in the first stage.

The fuels are incompletely burnt in the first stage with a substoichiometric proportion of air, and with an air coefficient ($\lambda$) at which practically no nitrogen oxides are formed. The combustion gases in the second stage are cooled to a temperature which lies far below the temperature which favors nitrogen oxide formation. In the second stage the combustion gases are cooled by mixing them with quenching air in a ratio essentially sufficient for the complete combustion of the above-mentioned, still combustible, components, such that the temperature of the exhaust gases thus formed rises to a temperature at which there is essentially no nitrogen oxide formation. These exhaust gases heat the process medium from its initial temperature at which it enters the process heat generation cycle to the aforesaid intermediate temperature of the first stage. The gases are then discharged from the process in a correspondingly cooled state.

The device for process heat generation according to the invention comprises a burner device and a primary air line connected to it. A preliminary combustion chamber is connected downstream of the burner device, and a heat exchanger is positioned in this preliminary combustion chamber for the final heating of the process medium. An air injection region is provided after this with a reduced flow cross-section when compared with the preliminary combustion chamber, and a ring of jets surrounds this cross-section, and which jets are connected to a quenching air line. The device further includes a secondary combustion chamber connected to the air injection region in which is accommodated a heat exchanger for preheating the process medium and to which is attached an exhaust gas duct. A process medium supply line discharges into an annular duct which is distributed around the circumference of the secondary combustion chamber after the aforesaid heat exchanger, and which annular duct is bounded by an external sheet casing of the secondary combustion chamber, of the air injection region and of the preliminary combustion chamber and by an inner sheet casing which extends over the same region, and which extends to the outlet region of the burner device. The annular duct is connected to the two heat exchangers in such a way that the process medium has to pass through them, and changing at its end in the outlet region of the burner device into a process medium discharge line for the process medium which has been heated to its final temperature.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein the single diagram of the drawing shows a longitudinal section through a preferred embodiment of the process heat generator of the invention.

DETAILED DESCRIPTION OF THE PREFERRED EMBODIMENT

Referring now to the drawings, wherein like reference numerals designate identical or corresponding parts, at the highest point of the process heat generator there is a burner device 1 of any known design, wherein liquid and/or gaseous fuel is the heating agent. A premix burner, in particular a double-cone burner, such as is described by European Patent Application 86109,039.7, is especially suitable for this application. The burner device 1 of the figure is a schematic representation of such a double-cone burner. It is designed as a dual burner for operation with a fuel oil and gas. Such a burner has the advantageous characteristic that, due to the good mixing of the fuel/air mixture which takes place in it, it is not possible for any zones or pockets to form in the following preliminary combustion chamber space with mixing ratios that are more favorable for $NO_x$ formation than in the remaining regions.

In a double-cone burner of this type, fuel oil 5 is supplied through a central fuel oil line 2 to a number of fuel oil jets 3 which surround the upper end of a double cone 4 in a circular configuration. This double cone 4 operates as a distributing and swirling device into which the fuel oil 5 is injected and atomized and is combined with primary air 7 injected in through a primary air line 6 to form a flammable mixture. Further details of this will be given below.

The fuel gas 8 passes through a fuel gas line 9 into two fuel gas distribution lines 10 from which it emerges through fuel gas jets 11 into the space bounded by the double cone 4 and takes part in the combustion of the fuel oil/air mixture in a preliminary combustion chamber 12 positioned after the burner 1. In the method according to the invention this takes place substoichiometrically, preferably with an air coefficient $\lambda=0.7$, which is approximately the optimum value within a range of $\lambda=0.6$–$0.8$ that is suitable in practice.

On account of the shortage of air and the proportion of the nitrogen, which is correspondingly low and uniform over the entire volume of the preliminary combustion chamber 12, substantially no nitrogen oxides are produced in this preliminary combustion phase as intermediate products of combustion which could then in part remain "frozen", that is, remain as such during the subsequent cooling of the combustion gases. In this preliminary combustion phase only very hot, oxygen-deficient, combustion gases appear, and the nitrogen present in the fuel is reduced due to the high temperatures of 1800°–1900° C. and the oxygen deficiency. The nitrogen is released from any possible bond with oxygen because the latter is required for the combustion.

After this sub-stoichiometric preliminary combustion, the partially burnt gases flow through a heat exchanger 13 or any design in which the process medium 14 to be heated draws so much heat from it that the gases are cooled to a temperature of 700°–900° C. and, as a consequence, an exhaust gas temperature of only 900°–1300° C. is produced in the subsequent stoichiometric secondary combustion. At those temperatures, it is hardly possible for nitrogen oxides to form.

In a secondary combustion stage, the partially burnt gases are mixed in an air injection region 15 with a cross-section which is narrow in comparison with the preliminary combustion chamber 12 with precisely the amount of air from a circular ring of swirl jets to combine with the still combustible gas components to give the stoichiometric ratio $\lambda=1$. This addition of air, which is referred to as quenching air and reaches the swirl jets 16 through a quenching air line 17, must take place rapidly in order to suppress oxidation of the nitrogen in the air. This mixture, which has once again become combustible, burns in the secondary combustion chamber 18 and heats the mixture to the aforesaid 900°–1300°. In spite of the fact that there is no longer a shortage of oxygen after the injection of air, hardly any nitrogen oxides are produced during this stoichiometric secondary combustion as a consequence of the low exhaust gas temperature. Moreover, with fuels which contain sulfur, the sulfur oxides in the above-mentioned temperature range occur hardly at all as $SO_3$, but almost only as $SO_2$, whereby the dew point of the exhaust gases remains low. The sulfur dioxide $SO_2$ can be removed easily by a desulfurization plant.

At the conclusion of the secondary combustion the exhaust gases flow through a second heat exchanger 19 and then, after giving up heat to the process medium 14, are led away through an exhaust gas duct 20.

The cold process medium 14 reaches, through a process medium line 21 which terminates in a circular line surrounding the exhaust gas duct 20, the heat exchanger 19 through which it flows in crossflow or parallelflow, depending on the design, and is collected at the outlet of the heat exchanger in an annular duct 22. The annular duct 22 is bound by an inner sheet casing 23 and a coaxial outer sheet casing 24, the latter forming the outer boundary of the process heat generator. The preheated process medium is heated to its final temperature in the heat exchanger 13 of the preliminary combustion chamber 12 and is supplied to the point of use via a process medium discharge line 25 at the upper end of the annular duct 22 in the outlet region of the burner device 1.

The device offers several possibilities for closed-loop, and if necessary, open-loop control of the process temperature: in the first instance by changing the supply of fuel and/or the air coefficient $\lambda$ in the preliminary combustion chamber 12 within the aforesaid range of 0.6 to 0.7, in which, moreover, it is also possible to increase to a value less than 0.8, but not higher, as smoke appears at $\lambda 0.8$. In this way it is possible to vary the temperature of the combustion gases at the inlet to the heat exchanger 13. The air injection offers a further possibility for influencing the process temperature. For complete combustion in the secondary combustion chamber 18, $\lambda$ must be equal to 1 with respect to the unburnt gas components. The temperature there can also be changed by a slight air excess, $\lambda>1$, although the scope is narrower than in the preliminary combustion chamber.

The air injection position is very suitable for installation of a catalyst, as conditions favoring its effectiveness, especially an essentially constant temperature, prevail there. It is especially advantageous to use honeycomb catalysts for this purpose. With a catalyst in the transition zone other unwanted chemical impurities in the exhaust gases in addition to the aforesaid harmful substances are converted into harmless compounds.

Obviously, numerous modifications and variations of the present invention are possible in light of the above teachings. It is therefore to be understood that within the scope of the appended claims, the invention may be practiced otherwise than as specifically described herein.

We claim:

1. An apparatus for the production of process heat with low $NO_x$ combustion, wherein by means of the combustion products of a fossil fuel, a process medium is heated in two stages to its final temperature, comprising:

a burner device and a primary air line assigned to the burner device, a preliminary combustion chamber connected downstream of the burner device, a first heat exchanger positioned in the preliminary combustion chamber for the final heating of the process medium, an air injection region provided downstream of the first heat exchanger and having a reduced flow cross-section when compared with the preliminary combustion chamber and a ring of jets surrounding the air injection region which jets are connected to a quenching air line, a secondary combustion chamber connected to the air injection region, in which secondary combustion chamber is accommodated a second heat exchanger for preheating the process medium, an exhaust gas duct attached to said second heat exchanger, an annular duct which is distributed around the secondary combustion chamber, a process medium supply line which discharges into the annular duct after the second heat exchanger, an external sheet casing of the secondary combustion chamber, of the air injection region and of the preliminary combustion chamber and an inner sheet casing that extends over the same region bounds said annular duct, said inner sheet casing extends to an outlet region of the burner device, the said annular duct being connected to the first and second heat exchangers in such a way so as to form a passageway for the process medium to pass through the heat exchangers and the annular duct, and said annular duct forming at its end in the outlet region of the burner device a process medium discharge line for the process medium which has been heated to its final temperature.

2. The apparatus as claimed in claim 1, wherein the burner device is a dual premix burner for liquid and gaseous fuel.

3. The apparatus as claimed in claim 1, wherein the burner device can use heating oil.

4. The apparatus as claimed in claim 1, wherein the burner device can use gas.

5. The apparatus as claimed in claim 1, wherein the burner device can use several fossil fuels.

6. The apparatus as claimed in claim 5, wherein the burner device can use heating oil and gas.

* * * * *